US005294765A

United States Patent [19]

Archibald et al.

[11] Patent Number: 5,294,765

[45] Date of Patent: Mar. 15, 1994

[54] PERFORATED SUSCEPTOR FOR MICROWAVE COOKING

[75] Inventors: William E. Archibald, Fullerton; Cynthia G. Scrimager, Anaheim, both of Calif.

[73] Assignee: Hunt-Wesson, Inc., Fullerton, Calif.

[21] Appl. No.: 721,827

[22] Filed: Jun. 26, 1991

[51] Int. Cl.[5] ..... H05B 6/80

[52] U.S. Cl. ..... 219/727; 219/729; 219/730; 426/107; 426/243; 99/DIG. 14

[58] Field of Search ..... 219/10.55 E, 10.55 F; 426/107, 234, 241, 243; 99/DIG. 14; 428/209

[56] References Cited

U.S. PATENT DOCUMENTS

| | | | |
|---|---|---|---|
| 4,735,513 | 11/1989 | Watkins et al. | 219/10.55 E |
| 4,861,957 | 8/1989 | Welles | 219/10.55 E |
| 4,904,836 | 2/1990 | Turpin et al. | 219/10.55 E |
| 4,927,991 | 5/1990 | Wendt et al. | 219/10.55 E |

FOREIGN PATENT DOCUMENTS 2022977A 12/1979 United Kingdom .

*Primary Examiner*—Philip H. Leung

*Attorney, Agent, or Firm*—Pretty, Schroeder, Brueggemann & Clark

[57] ABSTRACT

A perforated susceptor for use in disposable packaging that functions as the cooking container for a microwaveable food product such as popcorn. The susceptor includes a thin layer of microwave-interactive material, such as aluminum with an optical density of about 0.22 to 0.35. This layer is deposited on a substrate of a flexible plastic film. Perforations in the metallic layer are less than 0.060 inches in diameter, do not extend into the substrate, and are arrayed in rows and columns spaced at regular intervals of between 1/16 and 3/16 of an inch, so that the combined surface area of the perforations represents less than 20 percent of the area of the susceptor. The film can be directly bonded, through the perforations, to a sheet that forms part of a package.

34 Claims, 1 Drawing Sheet

PERFORATED SUSCEPTOR FOR MICROWAVE COOKING

FIELD OF THE INVENTION

The present invention relates to devices known as susceptors, capable of converting microwave energy to heat, and more particularly to susceptors used in disposable packaging for food products.

BACKGROUND OF THE INVENTION

Susceptors are commonly used to enhance microwave cooking techniques and apply those techniques to a wider variety of food products. They are usually incorporated in disposable food containers.

A typical susceptor includes a thin layer of microwave-interactive material, such as aluminum, deposited on a substrate, usually a plastic film. Most often, the susceptor is bonded to a sheet of paper that forms part of a bag or box.

A common problem associated with susceptors currently used in disposable packaging is their cracking and breakup during the cooking process. This problem, and the attendant risk of contamination of the food within the disposable packaging, are typically solved by overlaying the susceptor with a sheet of microwave-permeable and resilient material, or placing it between two or more layers of the material forming the food packaging.

This loss of the structural integrity of the susceptor is believed to be caused largely by differing coefficients of thermal expansion of the aluminum layer, the polyester substrate, the paper backing, and the adhesives that bond these layers together. The problem is exacerbated by the propensity of many plastic materials to expand significantly during the early stages of cooking, and then to shrink as the temperature increases beyond a certain level.

The breakup of a susceptor can be reduced by maintaining strict manufacturing tolerances during its production, and by judicious selection and uniform application of an adhesive. However, there are practical limitations on the degree to which manufacturing tolerances can be maintained during high volume production. Even minor variations in material thickness, for example, can trigger cracking and breakup of the susceptor.

In most instances the cracking and breakup of the susceptor is thought to start in the thin metallic layer of microwave-interactive material. These cracks begin to form early in the heating process, when the substrate expands at a considerably faster rate than the metallic layer deposited on it. However, as the temperature of the susceptor rises beyond a certain level, the substrate begins to shrink, while the metallic layer continues to expand. The resulting thermal stresses in the interface between the metallic layer and the substrate, as well as within the substrate, tend to propagate the random cracks in the metallic layer. It is thought that these cracks, as they become larger, cause corresponding cracks in the adjacent substrate. The cracks in the substrate may then be further enlarged due to internal stresses within the substrate.

It is believed that the breakup of the susceptor greatly reduces the heating effect of the microwave-interactive layer. It is theorized that this phenomenon is due to the tendency of the cracks to disrupt eddy currents in the susceptor that cause heating through $I^2R$ losses. The breakup of the susceptor therefore has a thermostatic effect, decreasing the generation of heat at the temperature at which breakup occurs. This thermostatic effect is not necessarily undesirable, as it may prevent overheating of the container and the food. However, two nominally similar susceptors may break up at substantially different temperatures due to manufacturing variances. Moreover, the entire surface of the susceptor does not necessarily break up uniformly or at the same time, thus introducing a further element of unpredictability. It is this unpredictable and mostly uncontrolled nature of the breakup that is undesirable. Furthermore, it is undesirable to permit the formulation of large cracks in the interactive layer, since it is these large cracks that are reflected in the substrate, causing the susceptor to lose its structural integrity.

It will thus be appreciated that there is a need for an improved susceptor that can be readily mass-produced and has an enhanced and predictable ability to resist cracking and breakup.

SUMMARY OF THE INVENTION

The present invention provides a susceptor for use in disposable packaging for microwaveable food products which has a substantially improved resistance to uncontrolled cracking and breakup and exhibits better structural integrity when exposed to microwave energy. Moreover, the susceptor of the invention is inexpensive and lends itself to high volume manufacture. It uses materials currently accepted for use in food containers.

The susceptor of the invention has a thin layer of microwave-interactive material deposited on a substrate. The substrate is typically a polyester film such as bi-axially oriented polyethylene terephthalate (PET). The microwave-interactive material is at least partly metal, having a coefficient of thermal expansion different from that of the substrate. A suitable microwave-interactive metal is aluminum which may be deposited on the substrate by a vacuum metallization process. The resulting layer of aluminum can have an optical density between about 0.22 and 0.35.

The breakup of the susceptor as a result of exposure to microwave energy is controlled and inhibited by perforations in the interactive layer. These perforations can be distributed over the layer in a repeating geometric pattern. It is advantageous to arrange round perforations less than about 0.060 inches in diameter in parallel rows and perpendicular columns, spaced about 1/16 to 3/16 inches apart. The combined area of the perforations represents less than 20 percent of the surface area of the interactive layer. The perforations do not extend into the substrate.

The susceptor of the invention may be used in a variety of containers of paper or similarly flexible, microwave-permeable sheet material. One particularly advantageous use of the invention is in a gusseted, flexible paper bag of popping corn. The susceptor of the invention is bonded to a portion of the interior surface of such bag.

The resistance of the susceptor to breakup is further enhanced by a direct, discontinuous bond between the interior surface of the bag and the substrate, formed through the perforations in the microwave-interactive layer. Because the susceptor of the invention has improved resistance to breakup, it can more confidently be positioned without a protective sheet, in direct contact with the food to be cooked, for optimum heat transfer.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENT

Figure 1:
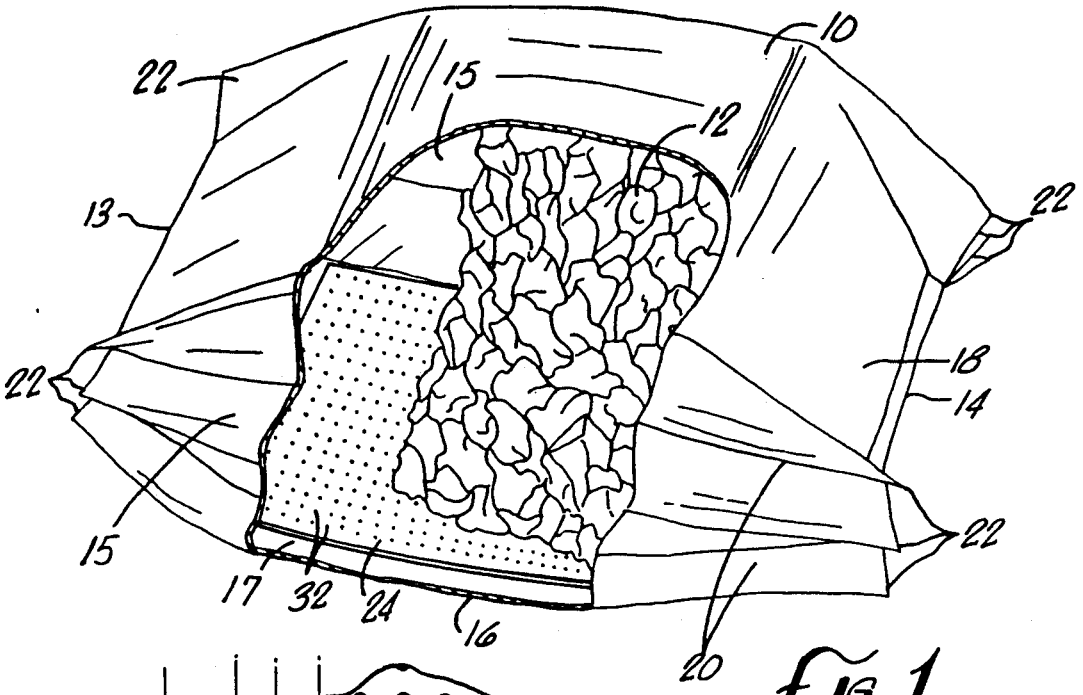
FIG. 1 is a perspective view, partly in cutaway section, of an expanded paper bag of popcorn, with a perforated susceptor bonded to the interior of a panel on which the bag rests during cooking (some of the corn being removed to reveal the susceptor)

A preferred embodiment of the present invention is in the form of a microwave popcorn container 10 that encloses an edible charge 12 of ready-to-pop corn, shortening, salt and seasonings, as shown in FIG. 1. The container 10 is a bag formed by a single ply of machine-finished paper of approximately 45 lb. weight. The bag 10 is of a tube-style construction, both the top and bottom ends 13 and 14 being wedge-shaped. It has two side panels 15, each of which is folded to form two gussets. It also has a front panel 16 and a back panel 18 that are connected by the side panels 15, and joined at the ends 13 and 14. The ends of each gusset 20 forms corners 22 that are free to move independently of the other gusset ends, thus allowing the bag 10 to take on a fuller, more rounded shape that is more efficient and promotes more effective cooking and popping of corn.

When the bag 10 is placed in a microwave oven (not shown) in the horizontal position (FIG. 1), the front panel 16 rests on the oven floor. A susceptor 24 is bonded to the interior surface 17 of the front panel 16 so that the edible charge 12, prior to cooking, is disposed on the susceptor.

Figure 3:
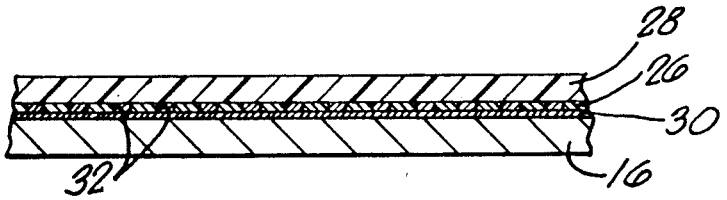
FIG. 3 is a further enlarged (not drawn to scale) fragmentary cross-sectional view of the susceptor taken along the line 3—3 of FIG. 2.

The susceptor 24 consists of a microwave-interactive layer 26 deposited on one surface of a plastic substrate 28, as best shown in FIG. 3. The substrate 28 is preferably a sheet of heat-set, bi-axially oriented PET of about 48-gauge. The microwave-interactive layer has a thin layer of aluminum 26 formed by vacuum metallization. (The thickness of this coating is greatly exaggerated in the drawing.) The aluminum layer has an optical density of about 0.22 to 0.35.

The susceptor 24, which includes both the substrate 28 and the aluminum layer 26, is bonded to the interior surface 17 of the front panel 16 by an adhesive layer 30, so that the polyester substrate 28 faces the interior of the bag 10, while the aluminum layer 26 is sandwiched between the interior surface 17 and the polyester substrate 28. It is preferable to use a self-cross-linking vinyl acetate co-polymer adhesive, such as Airflex 421, available from Air Products & Chemical Company, Inc. The susceptor 24 is bonded to the underlying paper by the application of the amount of pressure, and in some cases heat, appropriate to the specific adhesive and materials chosen. When using Airflex 421, PET and machine-finished paper, the adhesive should be applied at ambient temperature and with a calendar pressure between 10 and 15 psi.

Because the susceptor 24 is exposed to the interior of the bag 10, it is important to ensure the integrity of the substrate 28 which is located between the edible charge 12 and the aluminum layer 26, in direct contact with the charge. It has been found that this objective can be accomplished, even if relatively broad tolerances are permitted in the manufacture of the susceptor 24, by providing an array of perforations 32 in the aluminum layer 26. This arrangement can eliminate any need to overlay the susceptor with a sheet of microwave-permeable and resilient material, thereby simplifying the construction of the bag and improving the heat transfer between the susceptor 24 and the edible charge 12, while minimizing the possibility of food contamination.

It should be noted that although the perforations 32 extend fully through the aluminum layer 26, there are no corresponding openings in the substrate 28 or the front panel 16, which are unperforated and serve as barriers to protect the edible charge 12 and to contain steam during popping. Since the aluminum layer 26 is very thin, the adhesive layer 30 extends readily through perforations 32 to bond the substrate 28 to the interior surface 17 of the front panel 16. The perforations 32 thus permit direct, discontinuous bonding of the substrate 28 to the front panel 16, which is advantageous from the point of view of securing the susceptor 24. As to the bonding that takes place through the perforations, problems attributable to the coefficient of thermal expansion are greatly reduced. Moreover, the strength of the bond of the aluminum layer 26 to the substrate 28 is not a factor.

The size and spacing of the perforations 32 in the aluminum layer 26 represent a trade-off between the conflicting objectives of optimum thermal performance of the susceptor 24 and maximum strength of the adhesion of the susceptor to the interior surface 17 of the front panel 16. It is thought that, for optimal heating performance, the perforations 32 in the aluminum layer 26 should be sized so as to leave the largest possible metallized area to interact with the available microwave energy and to maximize the development of eddy currents in the aluminum layer 26. In contrast, the strength of the adhesion between the interior surface 17 of the front panel 16 and the polyester substrate 28 is in part a function of the size of the bonded area, i.e., the larger and more numerous the perforations in the aluminum layer 26, the stronger the direct bond between the interior surface 17 of the front panel 16 and the polyester substrate 28.

The perforations 32 can be formed by printing the aluminum layer 26 with an acid, such as hydrochloric acid, or with an alkaline etching solution, to produce the desired perforation pattern on the surface of the interactive layer 26. The exposed aluminum reacts with the etching solution, forming a soluble salt. The soluble salt is then removed by a rinsing step, leaving behind the desired patterns of perforations 32 in the aluminum layer 26.

Figure 2:
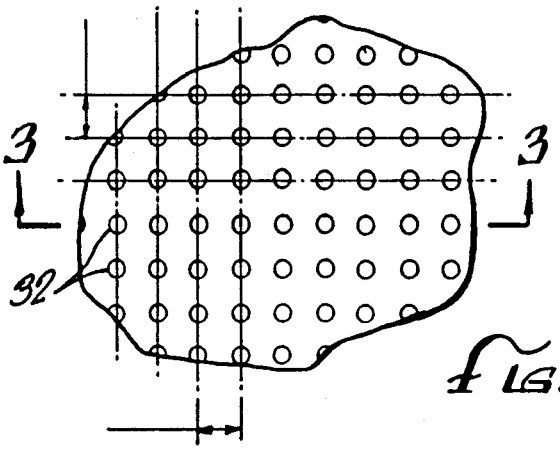
FIG. 2 is an enlarged, fragmentary plan view of the susceptor of the bag shown in FIG. 1.

It is advantageous to array the perforations 32 in a repeating geometric pattern, particularly parallel rows and perpendicular columns, as shown in FIG. 2. The perforations 32 are between about 0.025 and 0.060 inches (about 0.6 to 1.5 mm.) and preferably about 0.035 inches (or about 0.9 mm.) in diameter, spaced apart by about 1/16 of an inch (or 1.6 mm.) to 3/16 of an inch (or 4.76 mm.), and preferably about 3/32 of an inch (or about 2.4 mm.). The perforations 32 thus constitute less than 20 percent, and preferably less than 11 percent of the area within the outer boundaries of the aluminum layer 26.

When the bag 10 and the edible charge 12 are placed in a microwave oven and the charge is cooked, it is found that cracks form first in the aluminum layer 26 of the susceptor 24, as in a conventional susceptor. Unlike a conventional susceptor in which cracks appear to propagate randomly or along weak spots in the material, a perforated susceptor tends to form shorter, more controlled cracks that propagate from one perforation to another. In general, each crack terminates at a perforation at each end.

Since the cracks in a perforated susceptor 24 tend to form a more regular and predictable pattern, the smallest individual pieces of the aluminum layer 26 that are defined by the cracks are considerably larger than the smallest pieces of a conventional unperforated susceptor. Larger pieces, being bonded over a larger area, are less prone to break off and migrate away from the front panel 16.

In addition, the perforated interactive material 26 acts as a fuse, in that it begins to crack when it reaches a predetermined temperature. Once the continuity of this layer 26 is broken by these cracks, conversion of microwave energy into heat by the susceptor 24 greatly diminishes. In effect, the perforated interactive layer 26 functions as a self-limiting thermostat in which the peak temperature is pre-set by the thickness of the aluminum layer 26, as well as the size and scope of the perforations 32. This temperature-controlling effect is substantially uniform over the entire surface of the susceptor 24, the perforations 32 being uniformly distributed.

The effect of the perforations 32 is a markedly improved susceptor 24 which is more reliable, less affected by varying manufacturing tolerances, more predictable as a temperature control device, less susceptible to uncontrolled breakup, and less likely to separate from the interior surface of the front panel 16. It can, therefore, be placed, with confidence in a simpler, easier-to-manufacture container, in direct contact with the food being cooked, for efficient heat transfer between the susceptor 24 and the edible charge 12, thus minimizing the risk of food contamination.

While a particular form of the invention has been illustrated and described, it will be apparent that various modifications can be made without departing from the spirit and scope of the invention. Accordingly, it is not intended that the invention be limited, except as defined by the appended claims.

I claim:

1. For use in microwave heating of food products, a susceptor comprising:

a substrate; and a thin layer of microwave-interactive material deposited on said substrate having a coefficient of thermal expansion different from that of said substrate, said layer having a plurality of perforations distributed over the surface thereof without corresponding openings in said substrate, said perforations are substantially round and between about 0.025 to 0.060 inches in diameter, said perforations inhibiting the breakup of said susceptor when said susceptor is subjected to microwave energy.

2. The susceptor as defined in claim 1, wherein said perforations are arranged in a repeating geometric pattern.

3. The susceptor as defined in claim 1, wherein said perforations are about 0.035 inches in diameter.

4. The susceptor as defined in claim 1, wherein said perforations are arrayed in parallel rows and in columns perpendicular to said rows, spaced at regular intervals of between about 1/16 and 3/16 of an inch.

5. The susceptor as defined in claim 1, wherein the combined surface area of said perforations represents less than 20 percent of the surface area of said layer.

6. The susceptor as defined in claim 1, wherein said layer is at least partly a metal.

7. The susceptor as defined in claim 1, wherein said layer is at least partly aluminum.

8. The susceptor as defined in claim 1, wherein said layer is vacuum metallized aluminum.

9. The susceptor as defined in claim 1, wherein said layer is aluminum and has an optical density of between about 0.22 and 0.35.

10. The susceptor as defined in claim 1, wherein said substrate is a plastic film.

11. The susceptor as defined in claim 1, wherein said substrate is a polyester film.

12. The susceptor as defined in claim 1, wherein said substrate is polyethylene terephthalate film.

13. The susceptor as defined in claim 1, wherein:

said layer is vacuum-metallized aluminum;

said substrate is plastic; and said perforations are arranged in a repeating geometric pattern and represent less than about 20 percent of the surface area of said layer.

14. A container for microwave food products comprising:

a sheet of material forming at least part of said container; and a susceptor bonded to a portion of said sheet, said susceptor having a substrate and a thin layer of microwave-interactive material deposited on said substrate, said layer having a coefficient of thermal expansion different from that of said substrate, said layer having a plurality of perforations distributed over the surface thereof without corresponding openings in said substrate, said perforations are substantially round and between about 0.025 to 0.060 inches in diameter, said perforations inhibiting the breakup of said susceptor when said susceptor is subjected to microwave energy.

15. The container as defined in claim 14, wherein said container is a bag.

16. The combination as defined in claim 14, wherein said susceptor is mounted on said sheet so as to form a portion of the interior surface of said container.

17. The container as defined in claim 14, wherein said perforations are arranged in a repeating geometric pattern.

18. The container as defined in claim 14, wherein said perforations are about 0.035 inches in diameter and are arranged in a repeating geometric pattern.

19. The container as defined in claim 14, wherein said perforations are arrayed in parallel rows and columns perpendicular to said rows, spaced at regular intervals of between about 1/16 and 3/16 of an inch.

20. The container as defined in claim 14, wherein the combined surface area of said perforations represents less than about 20 percent of the surface area of said susceptor.

21. The container as defined in claim 14, wherein said layer is at least partly aluminum.

22. The container as defined in claim 14, wherein said layer is vacuum-metallized aluminum with an optical density of between about 0.22 and 0.35.

23. The container as defined in claim 14, wherein said substrate is a plastic film.

24. The container as defined in claim 14, wherein said substrate is a bi-axially oriented polyethylene terephthalate film of about 48 gauge.

25. The container as defined in claim 14, wherein:

said susceptor is positioned relative to said sheet so that said thin layer of microwave-interactive material is located between said sheet and said substrate; and said substrate is directly, but discontinuously bonded to said sheet through said perforations.

26. A container for microwave food products comprising:

a sheet of material forming at least part of said container; and a susceptor bonded to a portion of said sheet, said susceptor having a substrate and a thin layer of microwave-interactive material deposited on said substrate, said susceptor positioned relative to said sheet so that said layer is located between said sheet and said substrate, said layer having a plurality of perforations distributed over the surface thereof without corresponding openings in said substrate, said perforations are substantially round and between about 0.025 to 0.060 inches in diameter, wherein said perforations inhibit the breakup of said susceptor when said susceptor is subjected to microwave energy, and wherein said substrate is directly, but discontinuously bonded to said sheet through said perforations.

27. A combination comprising:

an edible charge of popping corn; and a container holding said charge and suitable for cooking said charge in a microwave oven, said container having a sheet of material forming at least a portion thereof and a susceptor bonded to said sheet, said susceptor having a substrate and a thin layer of microwave-interactive material deposited on said substrate, said layer having a coefficient of thermal expansion different from that of said substrate, said layer having a plurality of perforations distributed over the surface thereof without corresponding openings in said substrate or said sheet, said perforations are substantially round and between about 0.025 to 0.060 inches in diameter, said perforations inhibiting the breakup of said susceptor when said susceptor is subjected to microwave energy.

28. The combination as defined in claim 27, wherein said sheet is flexible paper.

29. The combination as defined in claim 27, wherein said container is a gusseted, flexible paper bag.

30. The combination as defined in claim 27, wherein said layer is vacuum-metallized aluminum having an optical density of between about 0.22 and 0.35.

31. The combination as defined in claim 27, wherein said perforations are arranged in a repeating geometric pattern.

32. The combination as defined in claim 27, wherein:

said perforations are about 0.035 inches in diameter and arrayed in parallel rows and in columns perpendicular to said rows, and are spaced at regular intervals of between about 1/16 and 3/16 of an inch; and the combined surface area of said perforations represents less than about 20 percent of the surface area of said layer.

33. The combination as defined in claim 27, wherein:

said susceptor is positioned relative to said sheet so that said layer of microwave-interactive material is located between said sheet and said substrate; and said substrate is directly, but discontinuously bonded to said sheet through said perforations.

34. A combination comprising:

an edible charge of popping corn and shortening; and a gussetted, flexible paper bag containing said charge and suitable for cooking said charge in a microwave oven, said bag having gussets openable under pressure of steam generated during cooking, and a susceptor bonded to a portion of the interior surface of said bag, said susceptor having a plastic substrate and a thin layer of microwave-interactive vacuum-metallized aluminum deposited on said substrate, said susceptor positioned relative to said bag so that said layer is located between said substrate and said interior surface of said bag, said layer having a coefficient of thermal expansion different from that of said substrate, said layer also having a plurality of substantially round perforations through which said substrate is directly, but discontinuously bonded to said interior surface of said bag, said perforations also serving to inhibit the breakup of said susceptor when said susceptor is subjected to microwave energy, said perforations being about 0.025 to 0.060 inches in diameter distributed over the surface of said layer and arrayed in parallel rows and columns perpendicular to said rows and spaced at regular intervals of between 1/16 and 3/16 of an inch, wherein the combined area of said perforations represents less than 20 percent of the surface area of said layer, there being no corresponding openings in said substrate.

* * * * *